United States Patent [19]

Van De Weijer et al.

[11] Patent Number: 4,864,191

[45] Date of Patent: Sep. 5, 1989

[54] RHENIUM-CONTAINING ELECTRODE FOR A HIGH-PRESSURE SODIUM DISCHARGE LAMP

[75] Inventors: Martinus H. A. Van De Weijer; Joseph F. R. Eijsermans, both of Eindhoven, Netherlands

[73] Assignee: U.S. Philips Corporation, New York, N.Y.

[21] Appl. No.: 193,184

[22] Filed: May 4, 1988

Related U.S. Application Data

[63] Continuation of Ser. No. 99,681, Sep. 16, 1987, abandoned, which is a continuation of Ser. No. 559,680, Dec. 9, 1983, abandoned.

[30] Foreign Application Priority Data

Dec. 30, 1982 [NL] Netherlands ..... 8205045

[51] Int. Cl.[4] ..... H01J 61/073; H01J 61/12

[52] U.S. Cl. ..... 313/633; 313/576; 313/643; 313/631

[58] Field of Search ..... 313/572, 573, 575, 576, 313/633, 570, 631, 574, 643

[56] References Cited

U.S. PATENT DOCUMENTS

| | | | |
|---|---|---|---|
| 4,002,940 | 1/1977 | Ekkelboom et al. | 313/633 X |
| 4,199,701 | 4/1980 | Bhattacharya | 313/25 |
| 4,260,929 | 4/1981 | Jacobs et al. | 313/572 X |
| 4,320,322 | 3/1982 | Rothwell, Jr. et al. | 313/349 X |
| 4,475,061 | 10/1984 | Van De Weijer et al. | 313/625 X |

*Primary Examiner*—Kenneth Wieder
*Attorney, Agent, or Firm*—Brian J. Wieghaus

[57] ABSTRACT

A high-pressure sodium discharge lamp provided with a solid electrode consisting mainly of tungsten plus a small quantity of rhenium, and free of alkaline earth metals. The addition of rhenium suppresses sodium attack which caused the tip end of the electrode to break off before the desired lamp life was reached.

6 Claims, 1 Drawing Sheet

RHENIUM-CONTAINING ELECTRODE FOR A HIGH-PRESSURE SODIUM DISCHARGE LAMP

This is a continuation of application Ser. No. 099,681 filed Sept. 16, 1987, now abandoned which is a continuation of Ser. No. 559,680 filed Dec. 9, 1983, now abandoned.

BACKGROUND OF THE INVENTION

The invention relates to a high-pressure sodium discharge lamp comprising a discharge envelope which is provided with a filling containing sodium and a rare gas, and at least one current-supply conductor which is passed through the wall of the envelope to a solid electrode consisting mainly of tungsten and free of alkaline earth metals. Such lamps, which are known from Dutch patent application No. 8005025, to which co-pending U.S. application Ser. No. 694,155 (assigned to the same assignee as the instant application) corresponds, have the advantage of a high luminous efficacy. The discharge envelope of such lamps consists of a crystalline oxide resistant to sodium vapour, such as, for example, mono-crystalline sapphire or densely sintered polycrystalline aluminum oxide. The filling of the discharge envelope may contain mercury in addition to the sodium and one or more rare gasses.

It has been found that in the known lamp in many cases the electrode is attacked, which in the end causes the electrode to break off, sometimes after an operating time of approximately 1000 hours. This causes the actual life of these lamps to be seriously less than the envisaged life of at least 2000 hours.

In literature a sintered electrode containing tungsten and rhenium has been suggested for a high-pressure discharge lamp. The electrode then further contains tantalum carbide. However, experiments have shown that under conditions prevailing in high-pressure sodium discharge lamps tantalum carbide gives rises to a rapid blackening of the discharge envelope due to sputtering and evaporation. Moreover, an electrode, which is not solid, but is sintered, has the property that sputtering will occur more readily than in a solid electrode.

SUMMARY OF THE INVENTION

The object of the invention is to suppress this life-limiting electrode attack phenomenon.

Therefore, according to the invention, the lamp of the kind mentioned in the opening paragraph is characterized in that the electrode contains rhenium in a quantity of at least 1% by weight.

It has been found that rhenium, in such a small quantity as 1% by weight, effectively suppresses the attack of the electrode. With a content of 3% by weight, just like with a higher content of, for example, 27% by weight, attack is completely prevented from occurring. Since rhenium is very expensive, that content of rhenium will be chosen which under the given conditions suppresses the attack in such a manner that this attack does not lead to the end of the life of the lamp. Therefore, in the majority of cases, a rhenium content of 1 to 3% by weight will be chosen.

The attack ascertained takes place, viewed in the longitudinal direction of the electrode, very locally, but occurs all round the circumference. The attack has the form of a removal of material on the side facing the discharge immediately followed by a deposition of material on the side remote from the discharge. A further analysis has shown that the attack takes place at the area at which the electrode has a temperature lying between 2000° K. and 2500° K. The mechanism on which the attack is based, however, has not been explained. Thus, the reason for the effect of rhenium also remains unknown.

In order to promote electron emission by the electrode so that a minimum electrode temperature will be sufficient during operation of the lamp, in the case of a lamp according to the invention, the material of the electrode may be provided with thorium oxide or yttrium oxide. Preferably, in lamps according to the invention, the electrode is pin-shaped and emitter-free. The rare gas used is xenon, filled to a pressure of at least 13 kPa (approximately 100 Torr) at 300° K. High pressure xenon is found to have the advantage that a blackening of the discharge envelope due to electrode material sputtered and evaporated during the starting stage is counteracted.

The emissive property of the inventive electrode is not substantially less than that of an electrode provided with thorium oxide, but the emitter-free electrode is easier to manufacture or yttrium oxide. Moreover, such an electrode is particularly suitable for use in small lamps, for example with a power consumption of 100 W or less.

An embodiment of a lamp according to the invention will be described more fully with reference to the drawing.

DESCRIPTION OF THE PREFERRED EMBODIMENT

Figure 1:
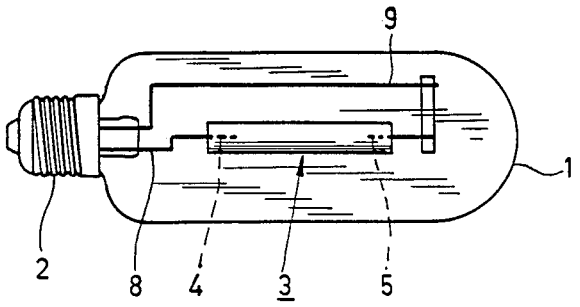
FIG. 1 is a diagrammatic view of a lamp according to the invention.

The lamp shown in FIG. 1 has an outer bulb 1 provided with a lamp cap 2. The outer bulb encloses a discharge envelope 3 provided with two electrodes 4,5. The electrode 4 is connected through a current-supply conductor 8 to a connection contact of the lamp cap 2. The electrode 5 is connected through a current-supply conductor in an analogous manner.

Figure 2:
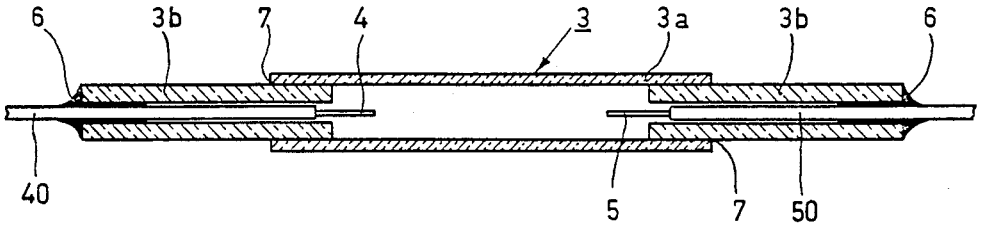
FIG. 2 is a sectional view of the discharge envelope of this lamp.

The discharge envelope 3 is composed, as shown in FIG. 2, of a discharge shape enclosed by an elongate tubular wall portion 3*a*, this wall portion being provided at its both ends with end wall portions 3*b*. The tubular wall portion 3*a* and the end wall portions 3*b* consist of densely sintered aluminum oxide and are connected to each other, for example, by means of sintered connections 7. The outer diameter of the wall portion 3*a* is 3.5 mm.

The discharge envelope is provided with two electrodes 4,5, which have the form of pins of tungsten containing 3% by weight of rhenium and are secured on pin-shaped current-supply members 40,50 of Nb. The pin-shaped tungsten electrodes of the lamp described have a diameter of 0.3 mm. The electrode gap is 13 mm. The pin-shaped current-supply members 40,50 are connected in a gastight manner to the end portions 3*b* by means of a sealing glass.

The filling of the discharge envelope of the lamp described contains xenon at a pressure of 50 kPa (approximately 375 Torr) at 300° K. and 5 mg of amalgam consisting of 27% by weight of Na and 73% by weight of Hg.

The lamp is operated through an inductive stabilization load of 390Ω at a supply source of 220 V, 50 Hz. For starting purposes, the lamp is connected in parallel to a starter. The lamp may also be provided with an external auxiliary electrode. The power consumed by the lamp is approximately 30 W, the lamp current being 0.47 A. The luminous efficacy is approximately 44 lm/W at a colour temperature of the emitted radiation of 2450° K. In the operating condition of the lamp, the electrode tips of the electrodes 4,5 assume a temperature of approximately 2700° K.

The lamp described is particularly suitable for interior illumination purposes.

What is claimed is:

1. In a high pressure sodium discharge lamp of the type including a ceramic discharge vessel, a pair of discharge electrodes disposed within said discharge vessel between which a discharge arc is maintained during lamp operation, a quantity of sodium or a sodium amalgam within said discharge vessel, and a rare gas within said discharge vessel, the improvement comprising:

means for suppressing localized removal of electrode material around the circumference of said electrode at a location spaced from the end of the electrode and deposition of electrode material to a side remote from the discharge, said means comprising said electrode containing rhenium in a quantity of at least 1% by weight.

2. A lamp as claimed in claim 1, characterized in that said electrode is a pin electrode containing approximately 3% rhenium by weight.

3. A lamp as claimed in claim 2, characterized in that said electrode is proportioned such that, in an operating condition, the electrode has a tip temperature of approximately 2700° K.

4. A lamp as claimed in claim 3, characterized in that said electrode is emitter-free; and in that said rare gas is xenon, having a pressure at 300° K. of approximately 50 kPa (375 Torr).

5. A lamp as claimed in claim 2, characterized in that said electrode is emitter-free; and in that said rare gas is xenon, having a pressure at 300° K. of at least 13 kPa (100 Torr).

6. A lamp as claimed in claim 1, characterized in that said electrode is emitter-free; and in that said rare gas is xenon, having a pressure at 300° K. of at least 13 kPa (100 Torr).

* * * * *